US005816914A

United States Patent [19]

Wichinsky

[11] Patent Number: 5,816,914

[45] Date of Patent: Oct. 6, 1998

[54] METHOD OF PLAYING A STUD POKER GAME

[76] Inventor: Michael Wichinsky, 2575 S. Highland Dr., Las Vegas, Nev. 89109

[21] Appl. No.: 838,166

[22] Filed: Apr. 16, 1997

[51] Int. Cl.[6] ..... A63F 1/00

[52] U.S. Cl. ..... 463/13; 273/292

[58] Field of Search ..... 273/292; 463/13

[56] References Cited

U.S. PATENT DOCUMENTS

| | | | |
|---|---|---|---|
| 4,836,553 | 6/1989 | Jones et al. | 273/292 |
| 4,861,041 | 8/1989 | Jones et al. | 273/292 |
| 5,022,653 | 6/1991 | Suttle et al. | 273/292 |
| 5,437,451 | 8/1995 | Fulton | 273/292 |

*Primary Examiner*—Benjamin H. Layno
*Attorney, Agent, or Firm*—John Edward Roethel

[57] ABSTRACT

A method of playing a poker game using a single standard fifty-two card deck of playing cards, five cards are dealt as the dealer's hand with all face cards dealt face up. Three cards are dealt face up as the player's hand. Two cards are then dealt—one face up and one face down—to be used as cards that can be selected by the player for use in the player's hand. The player selects either the face up card or the face down card. The selected card is added to the player's hand and is displayed face up. The unselected card is then discarded and two more cards are dealt—one card face up and one card face down. The player again selects either the face up card or the face down card. Again the selected card is added to the player's hand and is displayed face up with the unselected card being discarded. This results in the player having a complete five card hand. If the player's hand is higher than the dealer's hand based on conventional poker hand rankings, the player wins. When played as an electronic video casino game, the amount won by the player is based on the number of coins, tokens or credits wagered by the player and the poker ranking of the player's hand. A payout schedule is provided with the highest hand being a Royal Flush.

9 Claims, 3 Drawing Sheets

| | 1st COIN | 2nd COIN | 3rd COIN | 4th COIN | 5th COIN |
|---|---|---|---|---|---|
| ROYAL FLUSH | 500 | 1000 | 1500 | 2000 | PROG. |
| STRAIGHT FLUSH | 125 | 250 | 375 | 500 | PROG. |
| 4 OF A KIND | 20 | 40 | 60 | 80 | 100 |
| FULL HOUSE | 9 | 18 | 27 | 36 | 45 |
| FLUSH | 7 | 14 | 21 | 28 | 35 |
| STRAIGHT | 5 | 10 | 15 | 20 | 25 |
| 3 OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |
| HIGH HAND | ADVANCES PROGRESSIVE AMOUNTS | | | | |

| | 1st COIN | 2nd COIN | 3rd COIN | 4th COIN | 5th COIN |
|---|---|---|---|---|---|
| ROYAL FLUSH | 500 | 1000 | 1500 | 2000 | PROG. |
| STRAIGHT FLUSH | 125 | 250 | 375 | 500 | PROG. |
| 4 OF A KIND | 20 | 40 | 60 | 80 | 100 |
| FULL HOUSE | 9 | 18 | 27 | 36 | 45 |
| FLUSH | 7 | 14 | 21 | 28 | 35 |
| STRAIGHT | 5 | 10 | 15 | 20 | 25 |
| 3 OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |
| HIGH HAND | ADVANCES PROGRESSIVE AMOUNTS | | | | |

| | 1st COIN | 2nd COIN | 3rd COIN | 4th COIN | 5th COIN |
|---|---|---|---|---|---|
| ROYAL FLUSH | 500 | 1000 | 1500 | 2000 | PROG. |
| STRAIGHT FLUSH | 125 | 250 | 375 | 500 | PROG. |
| 4 OF A KIND | 20 | 40 | 60 | 80 | 100 |
| FULL HOUSE | 9 | 18 | 27 | 36 | 45 |
| FLUSH | 7 | 14 | 21 | 28 | 35 |
| STRAIGHT | 5 | 10 | 15 | 20 | 25 |
| 3 OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |
| HIGH HAND | ADVANCES PROGRESSIVE AMOUNTS | | | | |

| | 1st COIN | 2nd COIN | 3rd COIN | 4th COIN | 5th COIN |
|---|---|---|---|---|---|
| ROYAL FLUSH | 500 | 1000 | 1500 | 2000 | PROG. |
| STRAIGHT FLUSH | 125 | 250 | 375 | 500 | PROG. |
| 4 OF A KIND | 20 | 40 | 60 | 80 | 100 |
| FULL HOUSE | 9 | 18 | 27 | 36 | 45 |
| FLUSH | 7 | 14 | 21 | 28 | 35 |
| STRAIGHT | 5 | 10 | 15 | 20 | 25 |
| 3 OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |
| HIGH HAND | ADVANCES PROGRESSIVE AMOUNTS | | | | |

METHOD OF PLAYING A STUD POKER GAME

This invention relates to a stud poker game, and more particularly to a stud poker game in which the player's hand is played against a dealer's hand. If the player's hand beats the dealer's hand, the player wins with the amount of the winnings being based on a payout table.

BACKGROUND OF THE INVENTION

There have been many types of electronic video poker gaming machines that have been developed over the years, some of the poker games being stud poker games and some being draw poker games. Each electronic video poker gaming machine is designed to replicate the play of a hand of poker. In some of the embodiments of these games, the player is not playing against any other players or against a dealer's hand; the player is simply attempting to achieve the highest ranking poker hand possible from the cards displayed to the player. The higher the poker hand achieved by the player, the greater the player's winnings based on the number of coins, tokens or credits wagered by the player.

In other embodiments of these games, the player plays his hand against a dealer's hand with the higher hand winning based on conventional poker hand rankings. If the player's hand beats the dealer's hand, the player wins and the higher the poker hand achieved by the player when the player has a winning hand, the greater the player's winnings based on the number of coins, tokens or credits wagered by the player.

The forerunner of all electronic video poker gaming machines is the video Draw Poker machine that deals cards from a standard 52 card poker deck and displays a single five card hand to the player. This is a conventional "player's hand only" game since the player does not play against a dealer's hand, but is only trying to achieve the highest poker hand ranking he can for the player's hand. After the cards are electronically shuffled and an initial deal of five cards is displayed to the player, the player then selects which of the five cards he wishes to hold. The draw poker machine then displays replacement cards for the cards the player has discarded. The player wins or loses based on conventional poker hand rankings for the resulting five card hand. A payout table is established based on the number of coins, tokens or credits wagered by the player (credits can be wagered by the player if the gaming machine has a credit meter that accrues credits earned by the player during the play of the game) and the type of poker hand achieved.

Table 1 shows a typical payout schedule that can be used in electronic video draw poker machines of the "player's hand only" type.

TABLE 1

| | NUMBER OF COINS PLAYED | | | | |
|---|---|---|---|---|---|
| TYPE OF HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

The classic draw poker machine has been modified to use jokers as wild cards or to use deuces (or even other cards) as wild cards. "Joker's Wild" and "Deuces Wild" draw poker still display to the player a single five card hand and allow the player to discard unwanted cards and receive replacement cards. The payout table is modified to recognize the differing odds for achieving various poker hands when wild cards are involved.

Other types of "player's hand only" poker games have been adapted to run on electronic video gaming machines. In the electronic version of "player's hand only" seven card stud poker, the player wagers one or more coins, tokens or credits to be eligible to play the game and the player is dealt three cards initially. The player then has the option of folding in which case he loses his initial wager or betting additional coins, tokens or credits to receive additional cards. Eventually the player has either folded or received a full seven card hand. The player wins or loses based on conventional poker hand rankings for the best five cards of his seven card hand. A payout table is established based on the number of coins, tokens or credits wagered by the player and the type of poker hand achieved.

In the electronic version of "player's hand only" five card stud poker, the player wagers one or more coins, tokens or credits to be eligible to play the game and the player is dealt four cards initially. The player then has the option of staying or betting additional coins, tokens or credits to increase the amount of a winning payout when he receives the fifth card. After the fifth card is dealt to the player, the value of his five card hand is determined based on conventional poker hand rankings for his five card hand. A payout table is established based on the number of coins, tokens or credits wagered by the player and the type of poker hand achieved.

Some of the poker card games adapted to electronic video gaming machines display both the player's hand and a dealer's hand. This occurs in those games where the player must beat the dealer in order to win.

One example of these combined "player's hand/dealer's hand" games is CARIBBEAN STUD® poker. This game is described in U.S. Pat. No. 4,886,553, the disclosure of which is incorporated herein by reference.

Because of the proliferation of legalized gaming, the competition for players has increased. Operators of gaming machines have been increasing the payback percentage to attract players and the increase of the gaming percentage has resulted in a lowering of profits to the operators. There is a demand in the market for new gaming machines that create a higher volume of play so that profits can be increased even with the higher payback percentages that the players desire.

It is an object of the present invention to provide a stud poker game that uses a "player's hand/dealer's hand" format and that can be played in an electronic game format.

It is a feature of the present invention that five cards are dealt face up as the dealer's hand and three cards are dealt face up as the player's hand. Two additional selection cards are dealt —one face up and one face down. The player selects either the face up card or the face down card to be added to the player's hand. Again, two selection cards are dealt—one face up and one face down and the player selects either the face up card or the face down card to be added to the player's hand. This results in the player's hand now containing five cards. If the player's hand beats the dealer's hand, the player wins with the player's winning amount based on a payout schedule.

It is an advantage of the present invention that video poker players are provided with a new, exciting and creative five card stud game. The method of play requires skill on the part of the player with the potential for high payouts of either fixed or progressive amounts.

Other objects, features and advantages of the present invention will become apparent from a consideration of the following detailed description.

SUMMARY OF THE INVENTION

The game of the present invention is displayed on an electronic video gaming machine. Using a single standard fifty-two card deck of playing cards, five cards are dealt as the dealer's hand with all face cards dealt face up. Three cards are dealt face up as the player's hand. Two cards are then dealt—one face up and one face down—to be used as cards that can be selected by the player for use in the player's hand. The player selects either the face up card or the face down card. The selected card is added to the player's hand and is displayed face up. The unselected card is then discarded and two more cards are dealt—one card face up and one card face down. The player again selects either the face up card or the face down card. Again the selected card is added to the player's hand and is displayed face up with the unselected card being discarded. This results in the player having a complete five card hand. If the player's hand is higher than the dealer's hand based on conventional poker hand rankings, the player wins.

When played as an electronic video casino game, the amount won by the player is based on the number of coins, tokens or credits wagered by the player and the poker ranking of the player's hand. A payout schedule is provided with the highest hand being a Royal Flush.

DETAILED DESCRIPTION OF THE PREFERRED EMBODIMENTS

Figure 1:
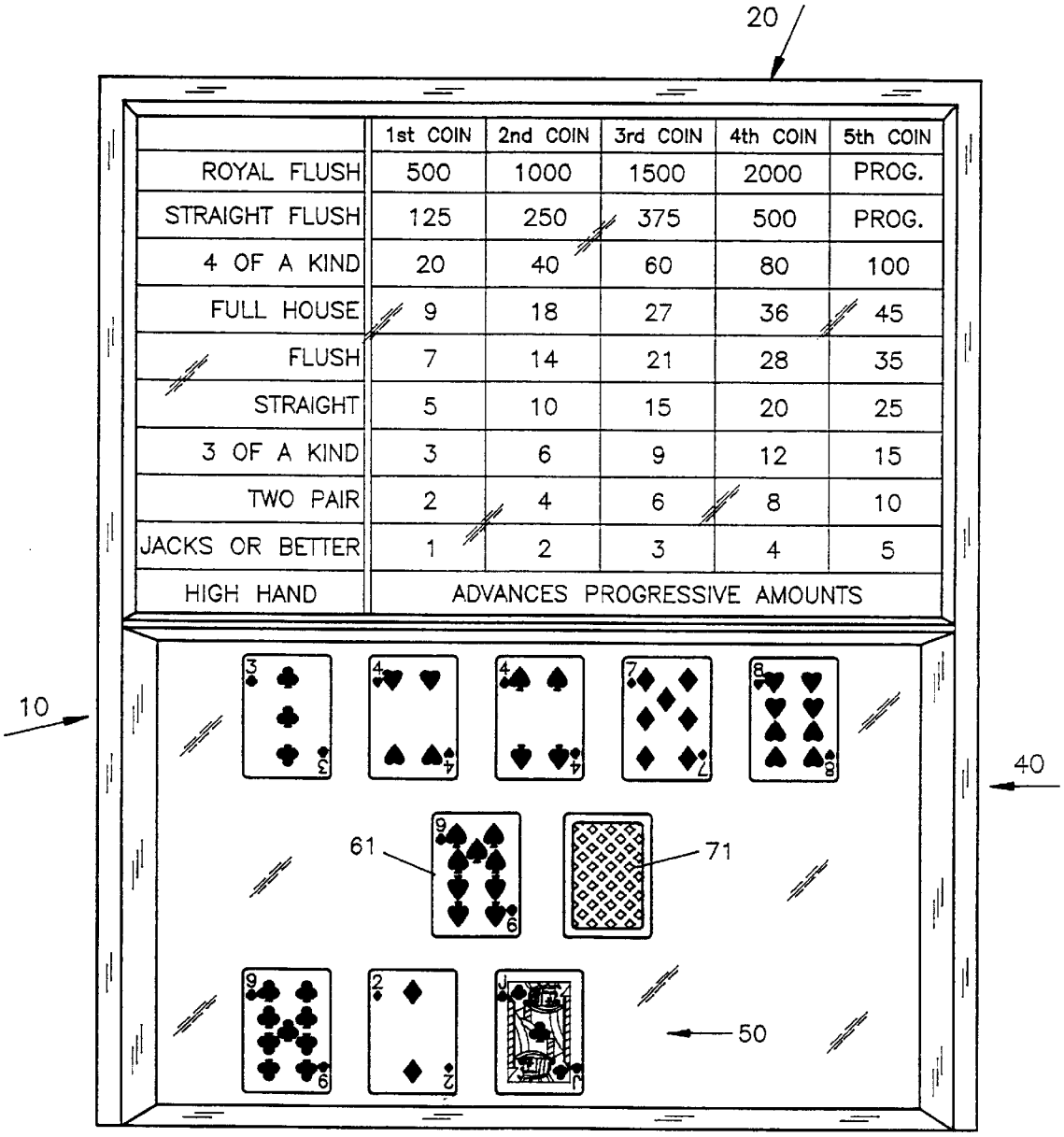
FIG. 1 shows schematically a pay table and a video display on an electronic video gaming machine of the method of play of the present invention after the dealer's hand has been dealt, the first three cards of the player's hand have been dealt and before the player has selected his fourth card.

The method of the present invention is preferably displayed on an electronic video gaming machine of the type used to display video draw poker and other similar games. As shown in FIG. 1, the electronic video gaming machine 10 comprises a pay table 20, preferably located on the front of the gaming machine above the video display, and a video display screen 30.

The present invention requires a screen display that is capable of showing both the dealer's hand 40 and the player's hand 50 as well as two additional card locations, the face up card location 61 and the face down card location 71.

The method of the present invention uses a single fifty-two card deck of standard playing cards. At the beginning of each round of the game, all of the cards are electronically shuffled. The player makes a wager to participate in the play of the game. The wager can be one or more coins, tokens or accrued credits as is conventional. In the preferred embodiment, the player wagers one to five coins, tokens or credits with the highest payouts being provided for the maximum wager of five coins, tokens or credits so as to encourage players to make the maximum wager.

After the player has made his wager, the game is activated by the player pressing a "Deal" button as is conventional. As is also conventional, if the player makes the maximum wager, the game activates automatically.

Initially, as shown in FIG. 1, five cards are displayed face up as the "Dealer's Hand" 40. A representative deal of the dealer's hand 40 is shown in FIG. 1 and the dealer has received the 3♣, 4♡, 4♠, 7♢ and 8♡.The dealer's hand has a pair of 4's as the highest poker hand ranking.

After the dealer's hand is dealt and displayed on the video screen 30, the first three cards of the player's hand 50 are dealt. A representative deal of the first three cards of the player's hand 50 is shown in FIG. 1 and the player has received the 9♣, 2♢ and J♣.

After the first three cards of the player's hand have been dealt, two selection cards 61 and 71 are dealt and displayed as cards to be used by the player to complete the player's hand. The selection cards are displayed one card face up 61 (which as shown in FIG. 1 is a 9♠) and one card face down 71.

The player selects either the face up card 61 or the face down card 71 and the selected card is then displayed in the player's hand as the player's fourth card. The non-selected card is then removed from the screen and is no longer available to be used in the game. As an alternative method of practicing the invention, the non-selected card can be left on the screen and only a replacement card is dealt for the card that has been selected and moved to the player's hand.

Figure 2:
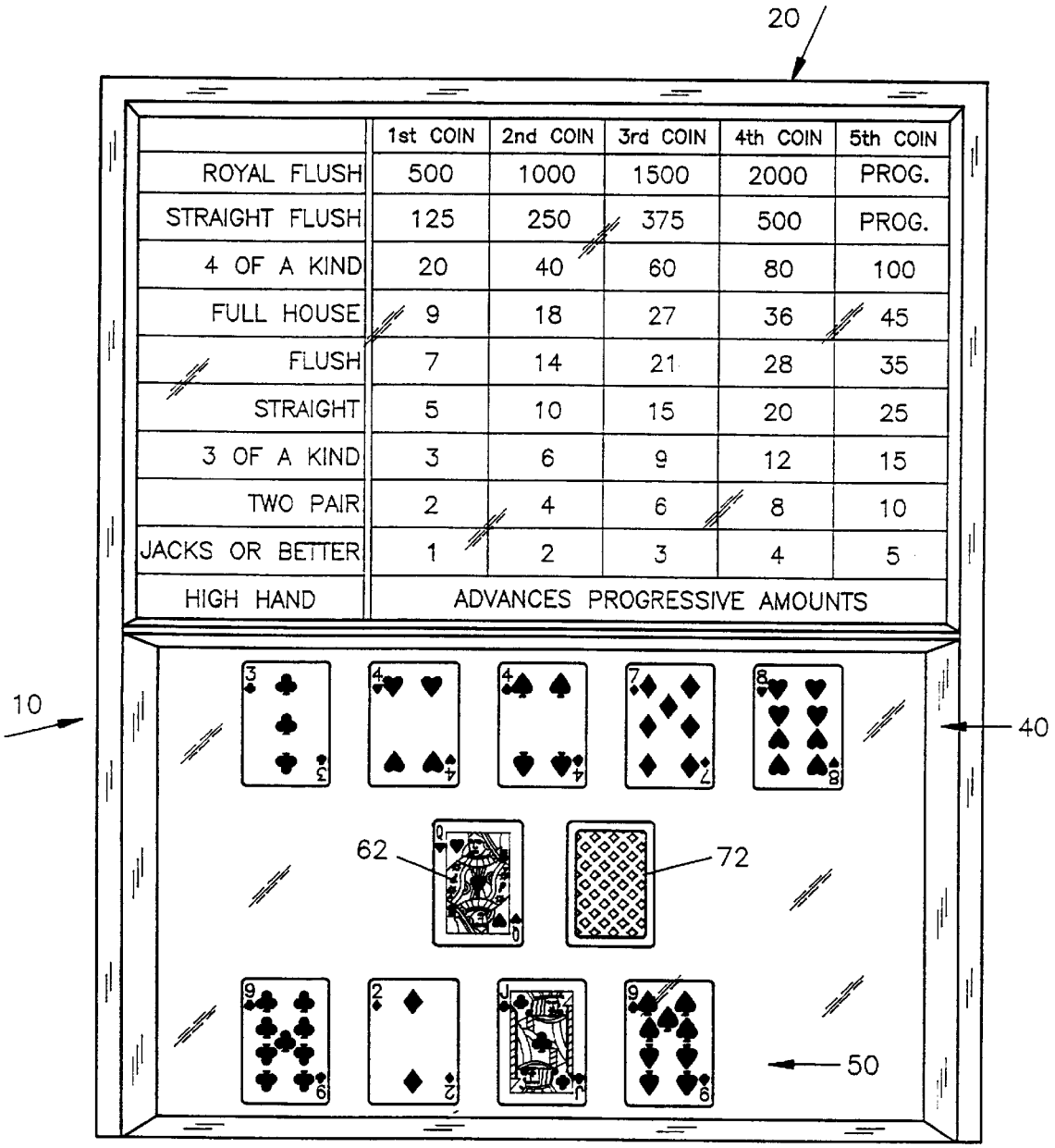
FIG. 2 shows schematically a pay table and a video display on an electronic video gaming machine of the method of play of the present invention after the player has selected his fourth card and before the player has selected his fifth card.

As shown in FIG. 2, the player has selected the face up card 61 (the 9♠) and this card is moved to the fourth position in the player's hand 50. Then, two more selection cards are then displayed, one face up 62 (the Q♡) and one face down 72. The player again selects either the face up card or the face down card and the selected card is displayed in the player's hand as the player's fifth and final card.

Figure 3:
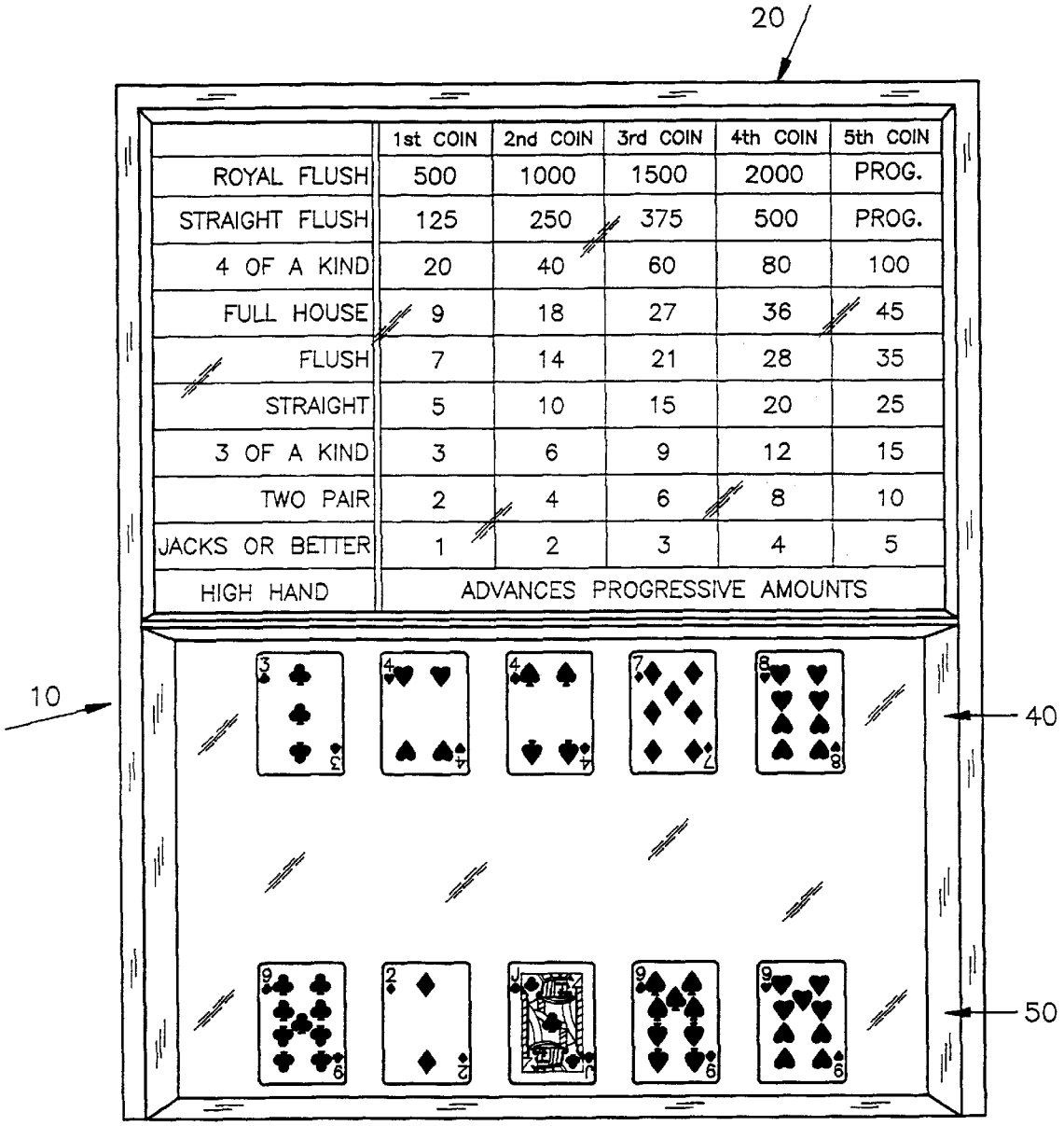
FIG. 3 shows schematically a pay table and a video display on an electronic video gaming machine of the method of play of the present invention after the player has selected his complete five card hand.

As shown in FIG. 3, the player selected the face down card 72 which turned out to be the 9♡ which is moved to the fifth position in the player's hand 50 giving the player three 9's. The rankings is the winning hand. If the dealer's hand is the higher hand, then the player loses his wager, the game is over and the player may engage in another round of the game.

If the player's hand is the higher hand, the player is the winner and the player receives a payout based on a payout schedule according to the number of coins, tokens or credits wagered by the player. In the example shown in drawings, the player's hand of three 9's beats the dealer's hand of a pair of 4's, so the player wins.

A typical payout schedule that can be used in the method of the present invention is shown in Table 2.

TABLE 2

| TYPE OF HAND | NUMBER OF COINS PLAYED | | | | |
|---|---|---|---|---|---|
| PLAYER'S WINNING HAND | 1 | 2 | 3 | 4 | 5 |
| ROYAL FLUSH | 500 | 1000 | 1500 | 2000 | Prog. |
| STRAIGHT FLUSH | 125 | 250 | 375 | 500 | Prog. |
| FOUR OF A KIND | 20 | 400 | 600 | 800 | 100 |

TABLE 2-continued

| TYPE OF HAND | NUMBER OF COINS PLAYED | | | | |
|---|---|---|---|---|---|
| PLAYER'S WINNING HAND | 1 | 2 | 3 | 4 | 5 |
| FULL HOUSE | 9 | 18 | 27 | 36 | 45 |
| FLUSH | 7 | 14 | 21 | 28 | 35 |
| STRAIGHT | 5 | 10 | 15 | 20 | 25 |
| 3 OF A KIND | 3 | 6 | 9 | 12 | 15 |
| 2 PAIRS | 2 | 4 | 6 | 8 | 10 |
| ANY PAIR | 1 | 2 | 3 | 4 | 5 |
| HIGH CARD HAND | Advances Progressive Amounts | | | | |

Again with reference to the example shown in the drawings, the player would win on the "3 Of A Kind" row with the winning amount being based on the number of coins, tokens or credits wagered by the player, e.g. if the player wagered five coins, tokens or credits, the player would win fifteen coins, tokens or credits in return.

In the payout table shown in Table 2, whenever the player makes a maximum wager of five coins, tokens or credits, the player may win a progressive jackpot amount for either a Royal Flush or a Straight Flush, assuming that the player's hand beats the dealer's hand. The electronic gaming machine 10 can be programmed to increment the progressive amounts according to any pre-established standard desired by the operator of the electronic gaming machine 10. In the preferred embodiment of the present invention, the progressive amount for the Royal Flush and the Straight Flush can be programmed to be incremented whenever the player's hand 50 beats the dealer's hand 40 but the player's hand only has a "High Card" higher the dealer's high card. That is, the player's hand wins with less than any pair.

Other methods of incrementing the progressive jackpot amounts for the Royal Flush and the Straight Flush may be employed. For example, a preselected percentage of each wager made can be applied to the progressive jackpot amounts for the Royal Flush and the Straight Flush. Or a preselected percentage of only the fifth coin wagers can be added to the progressive jackpot amounts for the Royal Flush and the Straight Flush.

Alternatively, either the Royal Flush payout or the Straight Flush payout or both can be made fixed amounts and not progressive jackpot amounts.

Other payout tables can be used depending on the percentage desired to be returned to the player and the percentage desired to be retained by the gaming establishment. Table 3 shows another representative payout table that can be used with the method of the present invention.

TABLE 3

| TYPE OF HAND | NUMBER OF COINS PLAYED | | | | |
|---|---|---|---|---|---|
| PLAYER'S WINNING HAND | 1 | 2 | 3 | 4 | 5 |
| ROYAL FLUSH | 500 | 1000 | 1500 | 2000 | Prog. |
| STRAIGHT FLUSH | 125 | 250 | 375 | 500 | Prog. |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 5 | 10 | 15 | 20 | 25 |
| 3 OF A KIND | 3 | 6 | 9 | 12 | 15 |
| 2 PAIRS | 2 | 4 | 6 | 8 | 10 |
| ANY PAIR | 1 | 2 | 3 | 4 | 5 |
| HIGH CARD HAND | Advances Progressive Amounts | | | | |

Likewise, Table 4 is yet another representative payout table that can be used with the method of the present invention.

TABLE 4

| TYPE OF HAND | NUMBER OF COINS PLAYED | | | | |
|---|---|---|---|---|---|
| PLAYER'S WINNING HAND | 1 | 2 | 3 | 4 | 5 |
| ROYAL FLUSH | 500 | 1000 | 1500 | 2000 | Prog. |
| STRAIGHT FLUSH | 125 | 250 | 375 | 500 | Prog. |
| FOUR OF A KIND | 25 | 500 | 750 | 100 | 125 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| 3 OF A KIND | 3 | 6 | 9 | 12 | 15 |
| 2 PAIRS | 2 | 4 | 6 | 8 | 10 |
| ANY PAIR | 1 | 2 | 3 | 4 | 5 |
| HIGH CARD HAND | Advances Progressive Amounts | | | | |

The method of the present invention can be modified from the manner of play discussed above. For example, the number of cards initially dealt to the player's hand can be varied from the three cards used in the preferred embodiment. For example, four cards, two cards, one card or even no cards can initially be dealt to the player's hand and then the player completes his hand by successively selecting the face up or face down card until the player's hand comprises a full five card hand.

Also, as discussed above, in the preferred embodiment of the present invention, whenever the player selects either the face up card or the face down card to be added to the player's hand, the non-selected card is discarded and removed from the screen and two new selection cards—one face up and one face down—are dealt. Alternatively, however, the non-selected card (whether face up or face down) can be left on the screen and only a replacement card for the selected card is dealt.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a poker game using a deck of cards comprising:

a) displaying five cards face up comprising a dealer's hand;

b) displaying three cards face up comprising an initial player's hand;

c) displaying two selection cards, one card face up and one card face down;

d) a player selecting either the face up card or the face down card and the selected card being displayed in the player's hand as the player's fourth card, removing the non-selected card from play wherein the non-selected card being no longer available to be used in the game;

e) displaying two more selection cards, one card face up and one card face down;

f) the player selecting either the face up card or the face down card and the selected card being displayed in the player's hand as the player's fifth card, removing the non-selected card from play wherein the non-selected card being no longer available to be used in the game; and g) comparing the player's hand to the dealer's hand with the hand having the higher poker hand ranking being declared the winning hand.

2. The method of claim 1 in which the deck of cards is a standard deck of fifty-two playing cards.

3. A method of playing a poker game using a deck of cards comprising:

a) a player making a wager to be eligible to participate in the play of the game;

b) displaying five cards face up comprising a dealer's hand;

c) displaying three cards face up comprising an initial player's hand;

d) displaying two selection cards, one card face up and one card face down;

e) a player selecting either the face up card or the face down card and the selected card being displayed in the player's hand as the player's fourth card, removing the non-selected card from play wherein the non-selected card being no longer available to be used in the game;

f) displaying two more selection cards, one card face up and one card face down;

g) a player selecting either the face up card or the face down card and the selected card being displayed in the player's hand as the player's fifth card, removing the non-selected card from play wherein the non-selected card being no longer available to be used in the game;

h) comparing the player's hand to the dealer's hand with the hand having the higher poker hand ranking being declared the winning hand; and i) if the player's hand is the winning hand, paying the player a predetermined amount based on the amount of the wager made by the player.

4. The method of claim 3 in which the player wagers between one and five coins, tokens or credits.

5. The method of claim 4 in which the amount paid to the player is based on a payout table.

6. The method of claim 5 in which the payout table comprises:

| TYPE OF HAND | NUMBER OF COINS PLAYED | | | | |
|---|---|---|---|---|---|
| PLAYER'S WINNING HAND | 1 | 2 | 3 | 4 | 5 |
| ROYAL FLUSH | 500 | 1000 | 1500 | 2000 | Prog. |
| STRAIGHT FLUSH | 125 | 250 | 375 | 500 | Prog. |
| FOUR OF A KIND | 20 | 400 | 600 | 800 | 100 |
| FULL HOUSE | 9 | 18 | 27 | 36 | 45 |

-continued

| TYPE OF HAND | NUMBER OF COINS PLAYED | | | | |
|---|---|---|---|---|---|
| PLAYER'S WINNING HAND | 1 | 2 | 3 | 4 | 5 |
| FLUSH | 7 | 14 | 21 | 28 | 35 |
| STRAIGHT | 5 | 10 | 15 | 20 | 25 |
| 3 OF A KIND | 3 | 6 | 9 | 12 | 15 |
| 2 PAIRS | 2 | 4 | 6 | 8 | 10 |
| ANY PAIR | 1 | 2 | 3 | 4 | 5 |
| HIGH CARD HAND | Advances Progressive Amounts | | | | |

7. The method of claim 5 in which the payout table comprises:

| TYPE OF HAND | NUMBER OF COINS PLAYED | | | | |
|---|---|---|---|---|---|
| PLAYER'S WINNING HAND | 1 | 2 | 3 | 4 | 5 |
| ROYAL FLUSH | 500 | 1000 | 1500 | 2000 | Prog. |
| STRAIGHT FLUSH | 125 | 250 | 375 | 500 | Prog. |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 5 | 10 | 15 | 20 | 25 |
| 3 OF A KIND | 3 | 6 | 9 | 12 | 15 |
| 2 PAIRS | 2 | 4 | 6 | 8 | 10 |
| ANY PAIR | 1 | 2 | 3 | 4 | 5 |
| HIGH CARD HAND | Advances Progressive Amounts | | | | |

8. The method of claim 5 in which the payout table comprises:

| TYPE OF HAND | NUMBER OF COINS PLAYED | | | | |
|---|---|---|---|---|---|
| PLAYER'S WINNING HAND | 1 | 2 | 3 | 4 | 5 |
| ROYAL FLUSH | 500 | 1000 | 1500 | 2000 | Prog. |
| STRAIGHT FLUSH | 125 | 250 | 375 | 500 | Prog. |
| FOUR OF A KIND | 25 | 500 | 750 | 100 | 125 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| 3 OF A KIND | 3 | 6 | 9 | 12 | 15 |
| 2 PAIRS | 2 | 4 | 6 | 8 | 10 |
| ANY PAIR | 1 | 2 | 3 | 4 | 5 |
| HIGH CARD HAND | Advances Progressive Amounts | | | | |

9. The method of claim 3 in which the deck of cards is a standard deck of fifty-two playing cards.

* * * * *